US008003938B2

(12) United States Patent
Brekenfeld

(10) Patent No.: US 8,003,938 B2
(45) Date of Patent: Aug. 23, 2011

(54) APERTURED DIAPHRAGMS BETWEEN RF ION GUIDES

(75) Inventor: Andreas Brekenfeld, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 79 days.

(21) Appl. No.: 12/604,594

(22) Filed: Oct. 23, 2009

(65) Prior Publication Data

US 2010/0102221 A1 Apr. 29, 2010

(30) Foreign Application Priority Data

Oct. 24, 2008 (DE) ..... 10 2008 053 088

(51) Int. Cl.
*H01J 49/36* (2006.01)

(52) U.S. Cl. ..... 250/288; 250/293

(58) Field of Classification Search ..... 250/281, 250/282, 288, 290, 293
See application file for complete search history.

(56) References Cited

U.S. PATENT DOCUMENTS

| | | | | |
|---|---|---|---|---|
| 3,396,634 | A | 8/1968 | Butterworth | |
| 3,867,632 | A | 2/1975 | Fite | |
| 3,937,954 | A | 2/1976 | Fite | |
| 4,013,887 | A | 3/1977 | Fite | |
| 4,283,626 | A | 8/1981 | Siegel | |
| 4,814,613 | A | 3/1989 | Fite et al. | |
| 6,674,071 | B2 * | 1/2004 | Franzen et al. | 250/292 |
| 7,391,021 | B2 * | 6/2008 | Stoermer et al. | 250/292 |
| 7,456,397 | B2 * | 11/2008 | Hartmer et al. | 250/292 |
| 7,847,246 | B2 * | 12/2010 | Brekenfeld | 250/290 |
| 2010/0090102 | A1 * | 4/2010 | Rather et al. | 250/283 |

FOREIGN PATENT DOCUMENTS

JP 2005276744 10/2005

OTHER PUBLICATIONS

German Office Action.
GB Search Report.

* cited by examiner

*Primary Examiner* — Bernard E Souw
(74) *Attorney, Agent, or Firm* — O'Shea Getz P.C.

(57) ABSTRACT

An apertured diaphragm disposed with an RF ion guide includes at least one of a weakly conductive solid dielectric material and a non-conducting dielectric with a weakly conducting surface layer.

7 Claims, 2 Drawing Sheets

APERTURED DIAPHRAGMS BETWEEN RF ION GUIDES

PRIORITY INFORMATION

This patent application claims priority from German patent application 10 2008 053 088.3 filed on Oct. 24, 2008, which is hereby incorporated by reference.

FIELD OF THE INVENTION

The invention relates to RF fields in ion guides and the way the fields are affected by apertured diaphragms.

BACKGROUND OF THE INVENTION

Apertured diaphragms may be disposed between ion guides for differential pumping systems with low gas conductivity. These apertured diaphragms are implemented to restrict a cross-section of an ion beam, or to accelerate or focus ions directed between the ion guides.

Typically, metallically conductive diaphragms cause the RF fields between the ion guides to break down. The RF fields continue uninterrupted through the material of the high-resistance apertured diaphragms to the next ion guide, and therefore the otherwise usual ion losses at the transitions between identical ion guides no longer occur.

Here, mass spectrometry is defined as ion spectrometry. The term "mass" refers to a "charge-related mass" m/z, rather than a "physical mass" m. "z" is defined as the number of excess elementary charges of an ion. Therefore, in the following disclosure the terms "mass" or "mass of the ions" are to be understood as a charge-related mass m/z, unless otherwise indicated.

In modern mass spectrometers, RF ion guides are used to guide ions from an ion source to a mass analyzer, and to manipulate the ions, for example, for fragmentation by collisions. In the simplest case, the RF ion guides are configured as multipole rod systems; i.e., quadrupole, hexapole or octopole rod systems having four, six or eight parallel pole rods disposed about an empty, cylindrical interior. During operation, two phases of an RF voltage are applied sequentially in turn to each pole rod. In an axis of the rod system (i.e., an axis of the cylindrical interior), the two phases cancel out such that there is a DC potential that corresponds to the zero crossing of the RF voltage. The interior of the rod systems have diameters ranging from around three to twenty millimeters. The RF voltage of the rod system ranges between a few tens and a few hundreds of volts at frequencies of around one to ten megahertz. The pole rods of the rod systems are typically constructed from metal. The multipole RF fields between the pole rods form so-called "pseudopotentials", which push the ions centripetally toward the axis. In the potential well of the pseudopotential, the ions can oscillate through the axis or about it. These oscillations are called "secular oscillations". In quadrupole rod systems, the pseudopotential increases as the square of a distance from the axis. Therefore, the secular oscillations are harmonic oscillations.

In addition to multipole rod systems, there are also other types of RF ion guides such as, for example, ion funnels or other ion guides consisting of ring electrodes. The direction and shape of the RF fields are substantially different from those of the aforementioned rod systems.

Ion guides typically contain a damping gas which dampens the motions of the ions, particularly their radial oscillations in the pseudopotential well, so that the ions quickly collect in the axis of the ion guides in a string-shaped cloud. This process is called "collisional focusing". The diameter of the string-shaped cloud is determined by (i) the equilibrium between the mass-dependent, (ii) centripetal force of the pseudopotential generated by the RF voltage and the centrifugally acting force of the space charge, and (iii) by the strength of the residual thermal motion. The damping gas may be provided from a vacuum-external ion source to be introduced together with the ions into the vacuum system. Alternatively, the dampening gas and the ions may be introduced separately.

Ions are transported in the ion guide via forward movement of the string-shaped cloud and partly by the space charge of the ions still being supplied by the ion source. If the damping gas originates from a vacuum-external ion source, for example an electrospray ion source, differential pumping systems with several pump chambers are typically used, through which the ions must be guided. This pumping system generates a continuous flow of gas molecules in the ion guides, which drive the ions through a series of ion guides in the direction of the ion analyzer. Notably, the term "ion guide" should be construed broadly. For example, an ion guide may include quadrupole filters which serve to select ions of a particular mass range for further analysis, and collision cells which serve to fragment ions.

In quadrupole filters, DC voltages are superimposed onto both phases of the RF voltage. As a result, only ions having a narrow mass range can pass through the filter on a stable path. In contrast, the remaining ions become radially unstable and thereafter are typically lost from the beam. Quadrupole filters are usually operated at very low vacuum pressures, for example below approximately $10^{-3}$ Pascal, such that no damping of the ion motions occurs in them. Ideally, no collisions should take place with molecules of residual gas. They therefore lack the onward transport of the ions by the streaming gas. Rather, the ions, which were injected with a given kinetic energy, fly through the mass filter via their inertia without being decelerated.

As stated above, ions are often generated at atmospheric pressures and transported in the vacuum through a series of pump chambers of a differential pumping system. Advantageously, an apertured diaphragm ("diaphragm") may be used to create a relatively small pumping cross-section in the wall between two of the pump chambers. For example, the aperture of the diaphragm can be sized almost as small as the diameter of the string-shaped cloud. If the diaphragm is disposed in the wall between the pump chambers in a sealed (i.e., air-tight) fashion, the aperture in the diaphragm defines the sole pumping connection. As a result, less expensive, lower performance pumps can be used. In such a configuration, the ion guides extend right up to the diaphragm on both sides. Alternatively, the cross-section of the ion beam can be matched to the acceptance profile of an adjacent downstream ion guide by an apertured diaphragm if the ion cloud does not already have a sufficiently small diameter.

It is further possible to use one or more diaphragms to create an ion lens which matches the ion beam to the acceptance profile. However, such a matching to the acceptance profile must be carefully observed when the ions are injected into a quadrupole filter. Using an accelerating ion lens, the ions can be accelerated into the next ion guide in order to fragment the ions via, e.g., relatively high-energy collisions.

Typically, prior art diaphragms are constructed from metal, or at least superficially metalized, to prevent electrical charges from building up on the surfaces and giving rise to undesirable, temporally varying field distortions. However, the metallic conductivity of the apertured diaphragms may short-circuit the RF field at the end of the ion guides. These short circuits may weaken the guiding field in the vicinity of the diaphragms such that considerable ion losses occur in front of and behind the diaphragm. In particular, components of the pseudopotential, which axially oppose the direction of the ion flow, may cause perturbations (i.e., turbulence) in the ion flow in the leakage field.

U.S. Pat. No. 3,867,632 and its continuations U.S. Pat. Nos. 3,936,634, 3,937,954 and 4,013,887, collectively referred to as the "W. L. Fite Patents" and hereby incorporated by reference, teach that a volume having superimposed RF and DC fields may be shielded such that, in the interior of the volume, the RF field is maintained practically unchanged, whereas the DC field is completely shielded. To provide such DC shielding, a material is used that has relatively weak conductivity and a resistance far in excess of $10^5$ Ohm×cm ("leaky dielectric"). In the W. L. Fite Patents, the shielding is configured in the form of a tubular channel connection piece through which the ions are introduced into an RF quadrupole filter while shielding the superimposed DC voltages. However, introduction of ions into an RF quadrupole rod system operating as a mass filter can be difficult and result in high ion losses due to a relatively small acceptance cross-section and acceptance angle.

U.S. Pat. No. 4,283,626 to M. W. Siegel ("Siegel Patent"), which is hereby incorporated by reference, discloses a tube constructed from a relatively high-resistance material that enables a region having a higher gas density to be formed in the interior of an RF multipole rod system. This region is formed to fragment the ions via gas collisions, for example, without losing the focusing effect of the RF field on entrained ions. Such collision cells usually have a gas drain to both sides because they are surrounded on either side by low pressure devices. These devices include a quadrupole filter disposed upstream of the ion flow to select the ions to be fragmented, and a mass analyzer disposed downstream of the ion flow. Therefore, it is advantageous for the fragment ions produced in the collision cell to be actively transported out of the collision cell by an electric field.

The Siegel Patent further discloses that a DC voltage gradient can be generated along the axis of the multipole rod system with the aid of such a tube. Different potentials are applied to the two ends of the tube such that a weak current through the tube generates a voltage drop. However, metal wires are used to apply the voltages and the end surfaces of the tube are made conductive via a metallic paint which causes the RF field to break down in the vicinity of the supply wires and the tube ends. Therefore, there is a need in the art to supply voltages without interfering with the RF fields.

SUMMARY OF THE INVENTION

According to one aspect of the invention, an apertured diaphragm for being disposed with an RF ion guide includes at least one of a weakly conductive solid dielectric material and a non-conducting dielectric with a weakly conducting surface layer.

According to another aspect of the invention, a mass spectrometer system is provided. The system includes a mass spectrometer, a plurality of RF ion guides, an apertured diaphragm, and an ion source. The apertured diaphragm includes at least one of a weakly conductive solid dielectric material and a non-conducting dielectric with a weakly conducting surface layer, and is disposed between the RF ion guides. The ion source directs ions towards the mass spectrometer through the RF ion guides and the apertured diaphragm.

In one embodiment, apertured diaphragms made from high-resistance, conductive materials (e.g., leaky dielectrics) are configured for use with ion guides. In contrast to the diaphragms in the W. L. Fite Patents, the diaphragms of the present invention effectively do not shield DC fields which are present. Rather, the disclosed diaphragms permit the RF fields of adjacent ion guides to pass practically unimpeded through their material without breaking down or becoming electrically charged by impinging ions. Advantageously, there is practically no ion losses during the passage of the ions between two identical ion guides because the RF field continues uninterrupted from the first to the second ion guide through the material of the diaphragm. The apertured diaphragms may also perform other tasks, such as, but not limited to, the mechanical limitation of gas flows or ion beam cross-sections, electrical acceleration, ion-optical beam focusing, etc.

The diaphragms can include thin disks of high-resistance solid material, such as weakly doped silicon, or ceramics containing a small proportion of carbon. The diaphragm material should have a resistance greater than $10^3$ ohmmeters (Ω×m), preferably between $10^4$ and $10^6$ ohmmeters, to conduct away impacting ions. The total ion current in the mass spectrometer is limited to about $10^{-10}$ amperes (about a billion ions per second), where impacting ions account for a small fraction thereof. The voltage of surface charges should be limited to, e.g., at most a fraction of a volt when ions impact.

The apertured diaphragms may also be constructed from nonconductors such as glass, ceramic, minerals or plastic which are coated with a high-resistance surface layer. The high-resistive layer may be manufactured, e.g., by tempering lead glass under reducing conditions such that a high-resistance, relatively thin layer of lead is produced close to the surface thereof from the lead oxide of the glass. This technique is well known in the art and has been used for many years in the manufacture of channeltron secondary electron multipliers.

The diaphragms can also be used to specifically feed voltages to high-resistance tubes which are embedded in ion guides. This allows potential gradients to be generated along the axis of the ion guides without the distortion or weakening of the RF fields in the vicinity of the voltage supplies that occurs in the Siegel Patent.

These and other objects, features and advantages of the present invention will become more apparent in light of the following detailed description of preferred embodiments thereof, as illustrated in the accompanying drawings.

DETAILED DESCRIPTION OF THE INVENTION

According to one embodiment of the invention, apertured diaphragms are constructed from a solid dielectric material having high resistivity for use with RF ion guides. These apertured diaphragms are disposed between two adjacent ion guides. This configuration permits the RF fields of the ion guides to pass unhindered through the material of the diaphragms, without substantially weakening the guidance of (e.g., re-directing) the ions as they travel between the ion guides. Advantageously, ion losses which regularly occur between prior art ion guides, and which can be considerable, are virtually eliminated by these diaphragms.

As set forth above, invention in the W. L. Fite Patents is aimed at the introduction of ions through a tube made from high-resistance dielectric into a quadrupole mass filter. Using this configuration, the invention in the W. L. Fite Patents shields a given space volume from electric DC fields, without simultaneously shielding the volume from RF fields. In contrast, such electric DC fields are typically not present in the present embodiment of the invention.

The invention presented here refers mainly to the improved transition between adjacent ion guides, which until now has been done via metallically conductive diaphragms.

Figure 1:
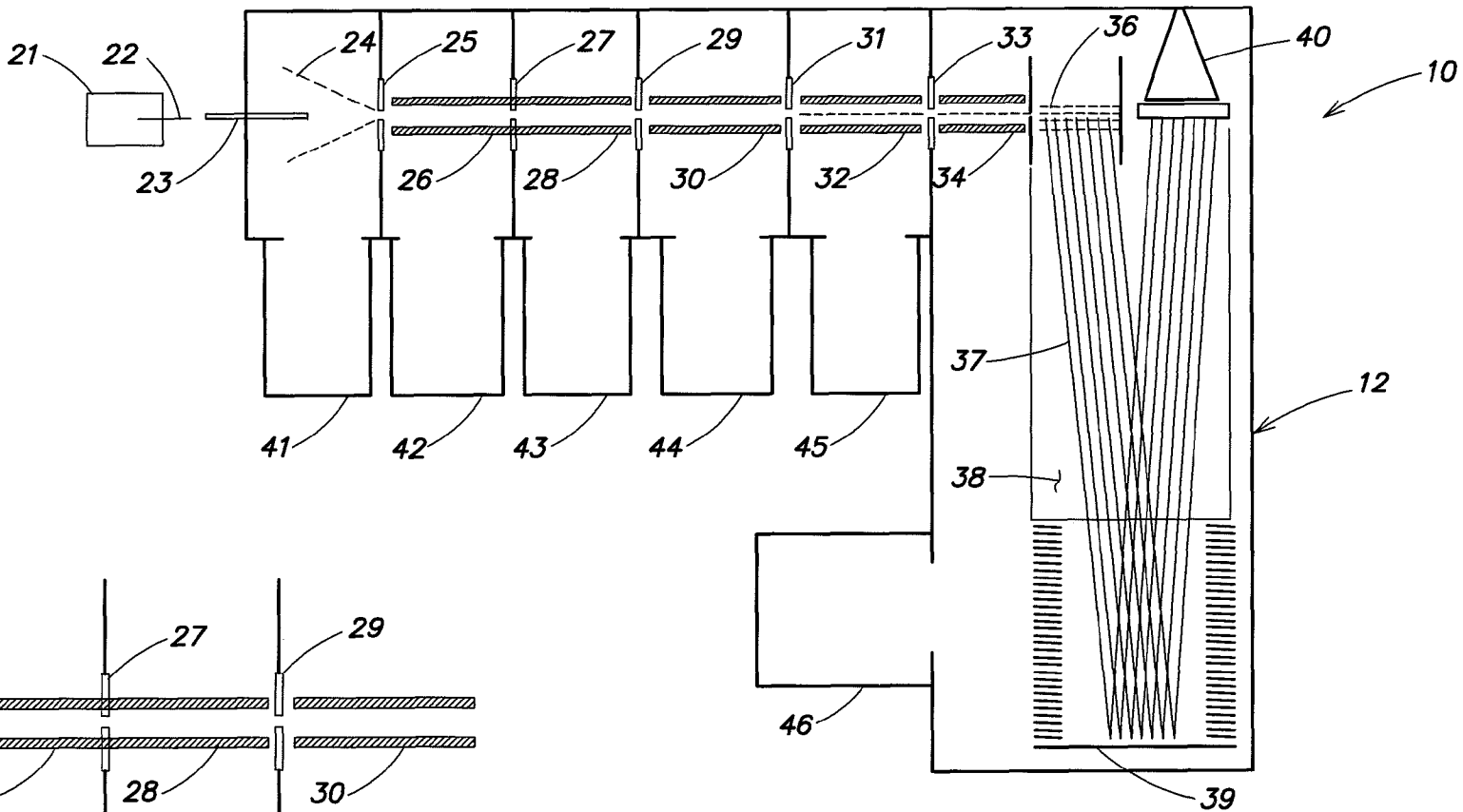
FIG. 1 is a sectional illustration of one embodiment of a time-of-flight mass spectrometer system.

Referring to FIG. 1, high-resistance dielectric apertured diaphragms 25, 27, 29, 31, 33 are disposed between two separate ion guides 26/28, 30, 32, 34, each ion guide including a set of pole rods (generally illustrated as elements 26/28, 30, 32, 34). Each diaphragm has a thin disk configuration and is adapted to be inserted between respective ion guides. In some embodiments, the ion guides have substantially identical configurations for the unhindered guidance of ions. For example, the ion guides may have the same number of pole rods of the same diameter and may be disposed equidistant from each other. In addition, the ion guides may have identical RF voltages applied to each other; i.e., the same voltage, the same frequency and the same phase. The pole rods should be closely adjoined to provide the most undisturbed field transition possible. The distribution of the RF field should be as equal as possible in every radial cross-section through the ion guide, and particularly in the area of the transition.

Conventional ion guides do not have axial potential gradients in the interior for propelling ion clouds therethrough. Rather, damping gas is propelled/driven through the ion guides via (i) the field of the space charge of the ions that are continuously supplied by the ion source and (ii) the gas stream that can extend, with decreasing pressures and increasing speed, from the ion source through the differential pumping stages up to an ion analyzer, or at least up to an ion selector. A quadrupole filter usually serves as the ion selector. If, however, the ion guide has a strong vacuum (e.g., below $10^{-3}$ Pascal), e.g., as in a quadrupole filter, the ions may fly (i.e., be directed) through the system practically without any collisions and with undiminished injection speed.

At the transitions between the ion guides, the ions may be further driven via different DC potentials in the axes of respective ion guides. The DC potentials in the axes are given by the average values of the voltages of the two RF phases applied. The potentials at the apertured diaphragms may also help to drive the ions forward. However, the additional forward drive may be negated where the pressure of the damping gas, and thus the damping of the forward motion, is not relatively low. Where the pressure of the damping gas is relatively low, the forward drive by the flow of gas molecules is also relatively small, and the additional drive may become mandatory.

It should be noted that an aspect of the present invention alternatively contemplates connecting different types of ion guides together, or using identical ion guides with different types of RF voltages. Advantageously, these configurations also create a transition for the ions that have fewer losses than the prior art metal apertured diaphragms.

Figure 2:
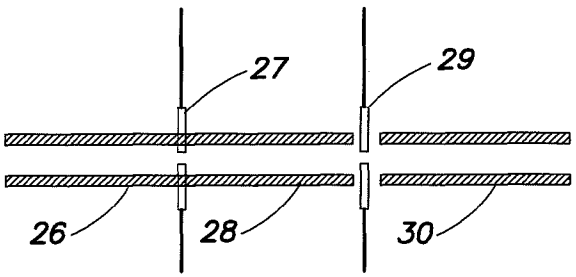
FIG. 2 illustrates an enlargement of a section of the mass spectrometer system in FIG. 1.

In a particularly loss-free arrangement, the diaphragm separates continuous pole rods used for the two ion guides such that a single ion guide has two sections. The diaphragm between the two sections has apertures for the pole rods in addition to the central passage opening for the ions. Referring to FIG. 2, the DC voltage of the diaphragm has the same potential as a mid potential of the RF voltage. In this embodiment, long pole rods of the ion guide 26/28 are divided by the diaphragm 27 into two sections (see FIG. 1) and extend through two pump chambers. These pump chambers are also separated by the apertured diaphragm 27. The apertured diaphragm 27 encloses the pole rods such that the tight-fitting holes are in contact with them, without shorting the RF voltage. In contrast to the apertured diaphragm 27, the apertured diaphragm 29 is located between the two separate rod systems 26/28 and 30. This arrangement is particularly suited for the guidance of the ions through the walls between differential pump chambers, where the ions are driven by the flowing gas. Notably, the diaphragm should be inserted into and sealed with the wall between the pump chambers.

FIG. 1 schematically illustrates one embodiment of a time-of-flight mass spectrometer system 10. The system 10 includes an electrospray ion source 21 having a spray capillary 22, an inlet capillary 23, an ion funnel 24, the plurality of ion guides 26/28, 30, 32 and 34, and a time-of-flight mass spectrometer 12. The electrospray ion source 21 injects ions orthogonally into the time-of-flight mass spectrometer 12 through the inlet capillary 23, the ion funnel 24 and the ion guides 26/28, 30, 32, 34.

The time-of-flight mass spectrometer 12 includes a pulser 36, a shielded region 38, an energy-focusing region 39 and an ion detector 40. A section of the narrow beam of ions injected by the electrospray ion source 21 is pulsed out perpendicular to the previous direction of flight by the pulser 36. The pulser 36 directs the pulsed ions as an ion beam 37 through the shielded region 38 and the energy-focusing reflector 39 to the ion detector 40. As known in the art, such pulsing can be repeated at, e.g., approximately 5 to 10 kilohertz resulting in, e.g., approximately 5,000 and 10,000 mass spectra per second, which are added together over specified time intervals to form sum spectra of high mass resolution.

Pumps 41-46 and corresponding pump chambers form a differential pumping system. The ion guides 26/28, 30, 32 and 34 are separated via a plurality diaphragms 25, 27, 29, 31 and 33. Notably, the present invention is not limited to the number or configuration of the ion guides in FIG. 1. For example, additional or fewer of such ion guides may be integrated with the mass spectrometer 12. Furthermore, the ion guides may assume different functions, such as guiding ions, selecting ions for fragmentation, fragmenting ions, etc.

In a first embodiment, the apertured diaphragms are constructed from a high-resistance solid material. For example, the diaphragms can be manufactured as thin disks of weakly doped semiconductor material such as silicon. In another example, the diaphragms may be constructed from a ceramic with a small proportion of carbon (e.g., "Ceramag"), which is commercially available with different conductivities. In still another example, by bombarding a doping material with ions, nonconductors may be transformed into weak conductors.

In a second embodiment, the apertured diaphragms are constructed from nonconductors such as, but not limited to, glass, ceramic, minerals or plastic which are coated with a high-resistance layer. The high-resistance surface layers may be formed, e.g., by tempering lead glass under reducing conditions in hydrogen, where a high-resistance, relatively thin layer of lead close to the surface is produced from the lead oxide of the glass. This manufacturing technique has been known for years and is used for the manufacture of channeltron secondary electron multipliers, or multi-channel plates (MCP).

The material for the diaphragms should have a specific resistance greater than approximately $10^3$ Ω×m, preferably between $10^4$ and $10^6$ Ω×m, and a small dielectric loss factor. Notably, as the resistance of the diaphragm is increased, there is a decrease in disturbances to the passage of the RF field and the discharge of electrical charges created by impinging ions. In mass spectrometers, the ion currents are limited to about $10^{-10}$ amperes (about a billion ions per second). Thus, the impacting ions, which are only a small fraction of the ion currents, are similarly limited. With the above-mentioned resistances, the surfaces build up a momentary charge of a few tens to a few hundreds of millivolts (mV), at most, when ions impact. Therefore, a small dielectric loss factor is used to prevent the heating from becoming too strong.

The diaphragms may also be used to supply voltages to devices in the interior of ion guides, in particular to tubes made of high-resistance material. In contrast to the Siegel Patent, by using high-resistance tubes, a DC potential gradient may be generated in the interior of an ion guide, without weakening the RF field in the interior. This DC potential gradient can be used to drive the ions to an adjacent ion guide. The DC potential gradient may also excite the ions to oscillate in the axial direction such that, e.g., ions are fragmented via collisions with molecules of a collision gas in a collision cell. In addition, potential gradients may be generated by using several voltage supplies to different parts of the tube, for example, in order to generate a potential trough in the axial direction where ions can be stored.

Figure 3:
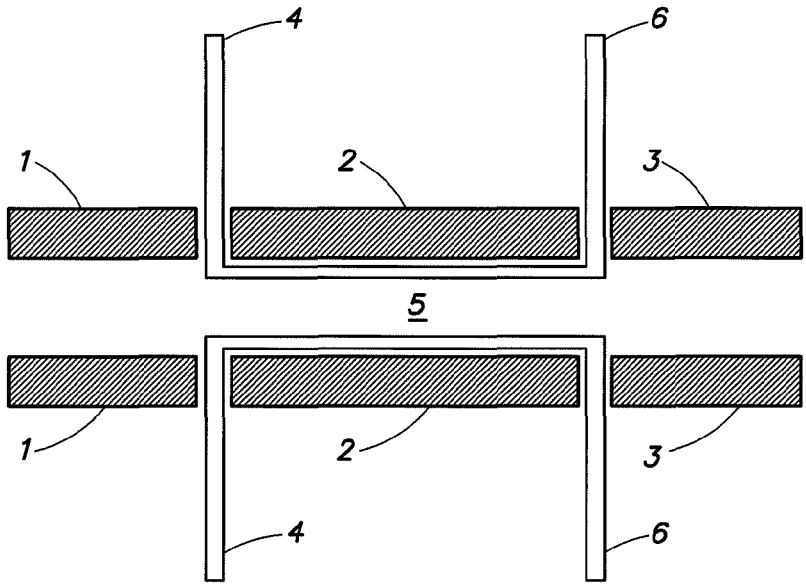
FIG. 3 schematically illustrates how a tube of high-resistance, conductive dielectric is inserted in a central rod system, and how the ends of the tube can be supplied with two voltages via the two apertured diaphragms to generate a voltage drop along the tube.

Referring to FIG. 3, diaphragms 4 and 6 are respectively disposed between ion guides 1, 2 and 2, 3 to provide voltages to tube 5 can foam a single body in the shape of a coil former. The pole rods of the ion guide 2 may then be positioned with insulation against and attached to the tube 5. On both sides, the pole rods should extend close to the apertured diaphragms 4 and 6. The diaphragms 4, 6 and the tube 5 may also be put together after the tube has been introduced into an ion guide; however, in this case the resistance of the joints must be restored correctly.

Figure 4:
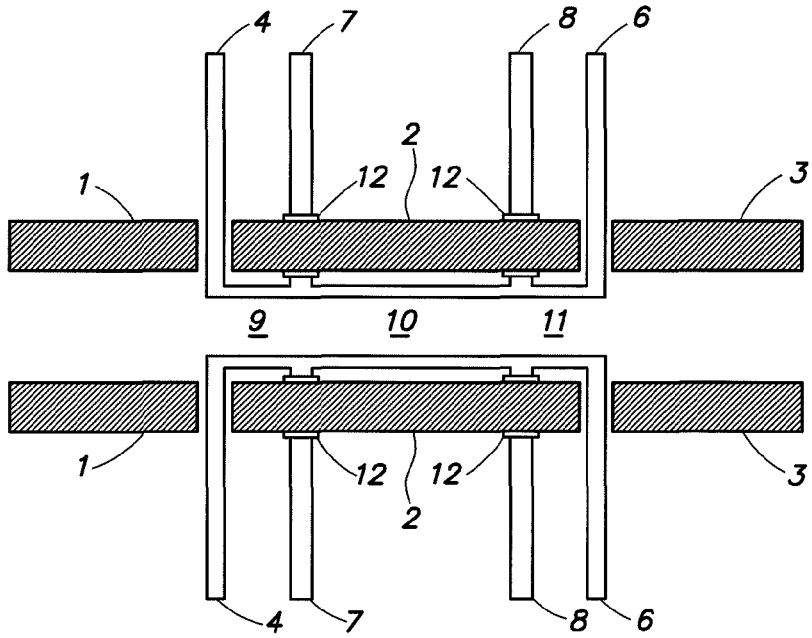
FIG. 4 schematically illustrates how a tube in the central rod system is divided by two additional apertured diaphragms into three sections, such that various potential profiles can be generated in the tube.

Additional diaphragms may be included to supply the tube with voltages at different locations. Referring to FIG. 4, two additional voltages are supplied through the apertured diaphragms 7 and 8, which form three different potential gradients to be set in the sections 9, 10 and 11 of the tube. The apertured diaphragms 7 and 8 are separated from the pole rods of the ion guide 2 by insulators 12 or by using suitably large aperture diameters. Advantageously, using these additional diaphragms 7, 8 it is possible, for example, to set a decreasing potential in section 9, a constant potential in section 10, and an increasing potential in section 11. This creates a potential well (e.g., an ion storage) that is operable as a collision cell and/or a reaction cell. Where the potential drops in sections 9 and 11 are relatively large, the ions are first powerfully accelerated, and then reflected between the two sections 9, 11. As they are reflected, the ions can acquire sufficient energy for a fragmentation by collisions with the damping gas. Once a sufficient number of ions have been fragmented, they can be ejected from the ion guide by switching the potentials, and fed to an analyzer for acquiring a mass spectrum of the ion fragments.

Ideally, the diaphragms supplying the voltages to the tube should receive their voltage equally over the entire outer rim in order to avoid creating complicated voltage drops, which in turn may generate very complex electric fields. Therefore, the outer rim of the apertured diaphragms is metalized to promote the equal voltage distribution. When there is a current through the tube, there is not only a voltage drop in the tube, but also a radially directed voltage drop through the apertured diaphragms. In order to eliminate or at least reduce this voltage drop, narrow conductive tracks are disposed onto the diaphragms. Notably, these conductive tracks will not interfere with the RF fields when they are radially centered in the middle between the pole rods since they are in the field-free planes of the RF field.

The apertured diaphragms can also have various forms; e.g., they can be curved. The diaphragms may also be split into segments, for example radial segments, in order to supply different voltages to devices within multipole rod systems.

It is further possible to combine several diaphragms, made from high-resistance dielectric, in a parallel arrangement to form lens or acceleration systems.

Although the present invention has been illustrated and described with respect to several preferred embodiments thereof, various changes, omissions and additions to the form and detail thereof, may be made therein, without departing from the spirit and scope of the invention.

What is claimed is:

1. An apertured diaphragm disposed with an RF ion guide, comprising at least one of a weakly conductive solid dielectric material and a non-conducting dielectric with a weakly conducting surface layer.

2. The apertured diaphragm of claim 1, wherein the resistance of the weakly conductive solid dielectric material is greater than approximately $10^3$ ohmmeters.

3. The apertured diaphragm of claim 2, wherein the resistance of the weakly conductive solid dielectric material is between approximately $10^4$ and $10^6$ ohmmeters.

4. The apertured diaphragm of claim 1, wherein the apertured diaphragm is positioned between two adjacent ion guides.

5. The apertured diaphragm of claim 1, wherein the apertured diaphragm serves as voltage connector for devices located inside the RF fields of ion guides.

6. The apertured diaphragm of claim 1, wherein the RF ion guide is split into several segments.

7. A mass spectrometer system, comprising:

a mass spectrometer;

a plurality of RF ion guides;

an apertured diaphragm comprising at least one of a weakly conductive solid dielectric material and a non-conducting dielectric with a weakly conducting surface layer, which apertured diaphragm is disposed between the RF ion guides; and an ion source that directs ions towards the mass spectrometer through the RF ion guides and the apertured diaphragm.

* * * * *

UNITED STATES PATENT AND TRADEMARK OFFICE

CERTIFICATE OF CORRECTION

PATENT NO. : 8,003,938 B2
APPLICATION NO. : 12/604594
DATED : August 23, 2011
INVENTOR(S) : Andreas Brekenfeld It is certified that error appears in the above-identified patent and that said Letters Patent is hereby corrected as shown below:

Column 7
Line 35, delete “foam” and insert --form--

Signed and Sealed this
Fourth Day of October, 2011

David J. Kappos

David J. Kappos
*Director of the United States Patent and Trademark Office*